US010829299B2

(12) United States Patent
Busch

(10) Patent No.: US 10,829,299 B2
(45) Date of Patent: Nov. 10, 2020

(54) CONTAINER SYSTEM WITH SUPPORTABLE LINER

(71) Applicant: Busch Systems International Inc., Barrie (CA)

(72) Inventor: Craig Busch, Barrie (CA)

(73) Assignee: Busch Systems International, Inc., Barrie (CA)

( * ) Notice: Subject to any disclaimer, the term of this patent is extended or adjusted under 35 U.S.C. 154(b) by 365 days.

(21) Appl. No.: 15/139,446

(22) Filed: Apr. 27, 2016

(65) Prior Publication Data

US 2017/0313503 A1 Nov. 2, 2017

(51) Int. Cl.

| | |
|---|---|
| ***B65F 1/00*** | (2006.01) |
| ***B65F 1/08*** | (2006.01) |
| ***B65F 1/14*** | (2006.01) |
| ***B65F 1/12*** | (2006.01) |

(52) U.S. Cl.

CPC ..... *B65F 1/006* (2013.01); *B65F 1/08* (2013.01); *B65F 1/085* (2013.01); *B65F 1/12* (2013.01); *B65F 1/1415* (2013.01); *B65F 1/0073* (2013.01)

(58) Field of Classification Search

CPC ..... B65F 1/08; B65F 1/04; B65F 1/085

USPC ..... 206/507, 519; 220/23.87, 23.88, 23.89, 220/495.01, 495.06, 495.08, 908.1

See application file for complete search history.

(56) References Cited

U.S. PATENT DOCUMENTS

| | | | | |
|---|---|---|---|---|
| 4,576,310 | A * | 3/1986 | Isgar | B65F 1/06 220/495.1 |
| 4,834,253 | A | 5/1989 | Crine | |
| 5,558,254 | A | 9/1996 | Anderson et al. | |
| 5,878,904 | A * | 3/1999 | Schweigert | B65F 1/085 220/23.4 |
| D586,521 | S | 2/2009 | Pho et al. | |
| D638,598 | S | 5/2011 | Ziech | |
| D681,301 | S | 4/2013 | Bennie et al. | |
| 8,584,886 | B1 | 11/2013 | Ellman et al. | |
| 8,607,981 | B2 * | 12/2013 | Wojno | B65D 21/0209 206/503 |
| D738,588 | S | 9/2015 | Bergemann et al. | |
| D757,385 | S | 5/2016 | Peake-Atkins et al. | |
| D763,531 | S | 8/2016 | Mattern et al. | |
| D779,761 | S | 2/2017 | Bergemann et al. | |

(Continued)

FOREIGN PATENT DOCUMENTS

| | | |
|---|---|---|
| DE | 10 2004 008 592 A1 | 1/2005 |
| EP | 0440889 | 5/1993 |

(Continued)

*Primary Examiner* — Jeffrey R Allen

(74) *Attorney, Agent, or Firm* — Woodard Emhardt Henry Reeves & Wagner LLP

(57) ABSTRACT

A waste or recycling container system is disclosed. The container system includes a container and a rigid liner for inserting into the container. The liner includes a supporting structure provided on a wall of the liner. The liner also includes bag retention structures. The liner is capable of being placed in the container in a first position and a second position. In the first position, the bag retention structures are below an opening of the container. In the second position, the supporting structure rests on a resting portion of the container walls and the liner is elevated with respect to the first position such that the bag retention structures are above the opening of the container.

24 Claims, 12 Drawing Sheets

(56) References Cited

U.S. PATENT DOCUMENTS

| | | | |
|---|---|---|---|
| D800,985 | S | 10/2017 | Bersch et al. |
| D805,707 | S | 12/2017 | Kopp et al. |
| D805,708 | S | 12/2017 | Kopp et al. |
| 2010/0176126 | A1 | 7/2010 | Shikano |

FOREIGN PATENT DOCUMENTS

| | | |
|---|---|---|
| EP | 1172307 | 1/2002 |
| EP | 1493688 | 1/2005 |

* cited by examiner

CONTAINER SYSTEM WITH SUPPORTABLE LINER

FIELD

The present disclosure relates generally to a waste or recycling container system and in particular to a waste or recycling container system with a supportable liner.

BACKGROUND

Society is becoming increasingly aware of a need to preserve the environment. Reducing litter and recycling are some ways humans can reduce their impact on the environment. Waste and/or recycling containers allow people to collect waste and/or recyclables so that they may be disposed of in an environmentally safe and friendly manner. Waste and/or recycling containers may include a liner with a bag retained in the liner to collect the waste and/or recyclables. Once the bag with waste and/or recyclables is to be thrown out or emptied, it may be removed from the container and replaced with a new, empty bag.

SUMMARY

This summary is provided to introduce a selection of concepts in a simplified form that are further described below in the Detailed Description. This Summary is not intended to identify key features or essential features of the claimed subject matter, nor is it intended to be used to limit the scope of the claimed subject matter.

An aspect of embodiments disclosed herein relates to a waste or recycling container system comprising: a container comprising a container base and one or more container walls extending upwardly from the container base, the one or more container walls defining a first interior space and a first opening; and a rigid liner for inserting into the first interior space, the liner comprising: a liner base and one or more liner walls extending upwardly from the liner base, the one or more liner walls defining a second interior space and a second opening, a supporting structure provided on one of the one or more liner walls, and one or more bag retention structures provided on the one or more liner walls, wherein the liner is capable of being placed in the first interior space in at least a first position and a second position, wherein, in the first position, the bag retention structures are below the first opening, and wherein, in the second position, the supporting structure rests on a resting portion of the one or more container walls and the liner is elevated with respect to the first position such that the one or more bag retention structures are above the first opening.

In some embodiments, a rim of the container around the opening comprises the resting portion.

In some embodiments, the supporting structure comprises a cantilever extending from the one liner wall for resting on the rim in the second position.

In some embodiments, the cantilever extends across a width of the one liner wall.

In some embodiments, the supporting structure further comprises one or more anchor portions that extend downwardly from an end of the cantilever for forming a channel between the one or more anchor portions and the one liner wall, the channel having a channel profile.

In some embodiments, the channel profile is complementary to a rim profile of the rim.

In some embodiments, the one or more anchor portions each comprise a planar surface opposite the one liner wall for sliding along a portion of the one or more container walls as the liner is placed into the second position.

In some embodiments, the liner further comprises a handle.

In some embodiments, the handle is provided at a midpoint of a width of the cantilever.

In some embodiments, the handle is formed by a portion of a handle wall between a handle cutout provided in the handle wall and the second opening, the handle wall extending upwardly from an end of the cantilever.

In some embodiments, the portion of the handle wall is recessed from an outermost extent of the supporting structure.

In some embodiments, the one or more anchor portions comprise two anchor portions provided symmetrically about the handle.

In some embodiments, one of the one or more bag retention structures comprises a cutout.

In some embodiments, one or more liner walls comprise two liner walls that meet at an edge, and the cutout extends across the edge.

In some embodiments, the liner is a moulded, unitary piece.

Another aspect of embodiments disclosed herein relates to a rigid liner for a waste or recycling container, the liner comprising: a liner base and one or more liner walls extending upwardly from the liner base, the one or more liner walls defining an interior space and an opening, a supporting structure for supporting the liner on the container, the supporting structure provided on one of the one or more liner walls, wherein the supporting structure comprises a cantilever extending from the one liner wall and one or more anchor portions extending downwardly from an end of the cantilever for forming a channel between the one or more anchor portions and the one liner wall, and one or more bag retention structures provided on the one or more liner walls, wherein the one or more bag retention structures are provided above the channel.

In some embodiments, the liner further comprises a handle.

In some embodiments, the handle is provided at a midpoint of a width of the cantilever.

In some embodiments, the handle is formed by a portion of a handle wall between a handle cutout provided in the handle wall and the opening, the handle wall extending upwardly from an end of the cantilever.

In some embodiments, the portion of the handle wall is recessed from an outermost extent of the supporting structure.

In some embodiments, the one or more anchor portions comprise two anchor portions provided symmetrically about the handle.

In some embodiments, the cantilever extends across a width of the one liner wall.

In some embodiments, one of the one or more bag retention structures comprises a cutout.

In some embodiments, the one or more liner walls comprise two liner walls that meet at an edge, and the cutout extends across the edge.

In some embodiments, the liner is at least partially nestable with another identical liner.

In some embodiments, the liner is a moulded, unitary piece.

Other aspects and features of embodiments of the present disclosure will become apparent to those ordinarily skilled in the art upon review of the following description.

BRIEF DESCRIPTION OF THE DRAWINGS

Examples of embodiments of the invention will now be described in greater detail with reference to the accompanying drawings, in which.

DETAILED DESCRIPTION

Some embodiments of the present disclosure relate to a waste or recycling container system. The container system includes a container with a base and walls extending upwardly from the base that define an opening of the container. The container system further includes a rigid liner for inserting into the container. The liner also has a base and walls extending upwardly from the base. A supporting structure is provided on an exterior of one of the liner walls. The liner also includes bag retention structures provided on its walls. The liner is capable of being placed in the container in at least a first position and a second position. In the first position, the bag retention structures are below the opening of the container. In the second position, the supporting structure rests on a portion of the container walls and the liner is elevated with respect to the first position such that the bag retention structures are above the opening of the container.

Some embodiments of the present disclosure relate to a rigid liner for a waste or recycling container. The liner has a base and walls extending upwardly from the base. A supporting structure for supporting the liner on the container is provided on an exterior of one of the liner walls. The supporting structure includes a cantilever extending from a liner wall and anchor portions extending downwardly from an end of the cantilever, thereby forming a channel between the anchor portions and the liner wall. Bag retention structures are provided on the liner walls above the channel.

Figure 7:
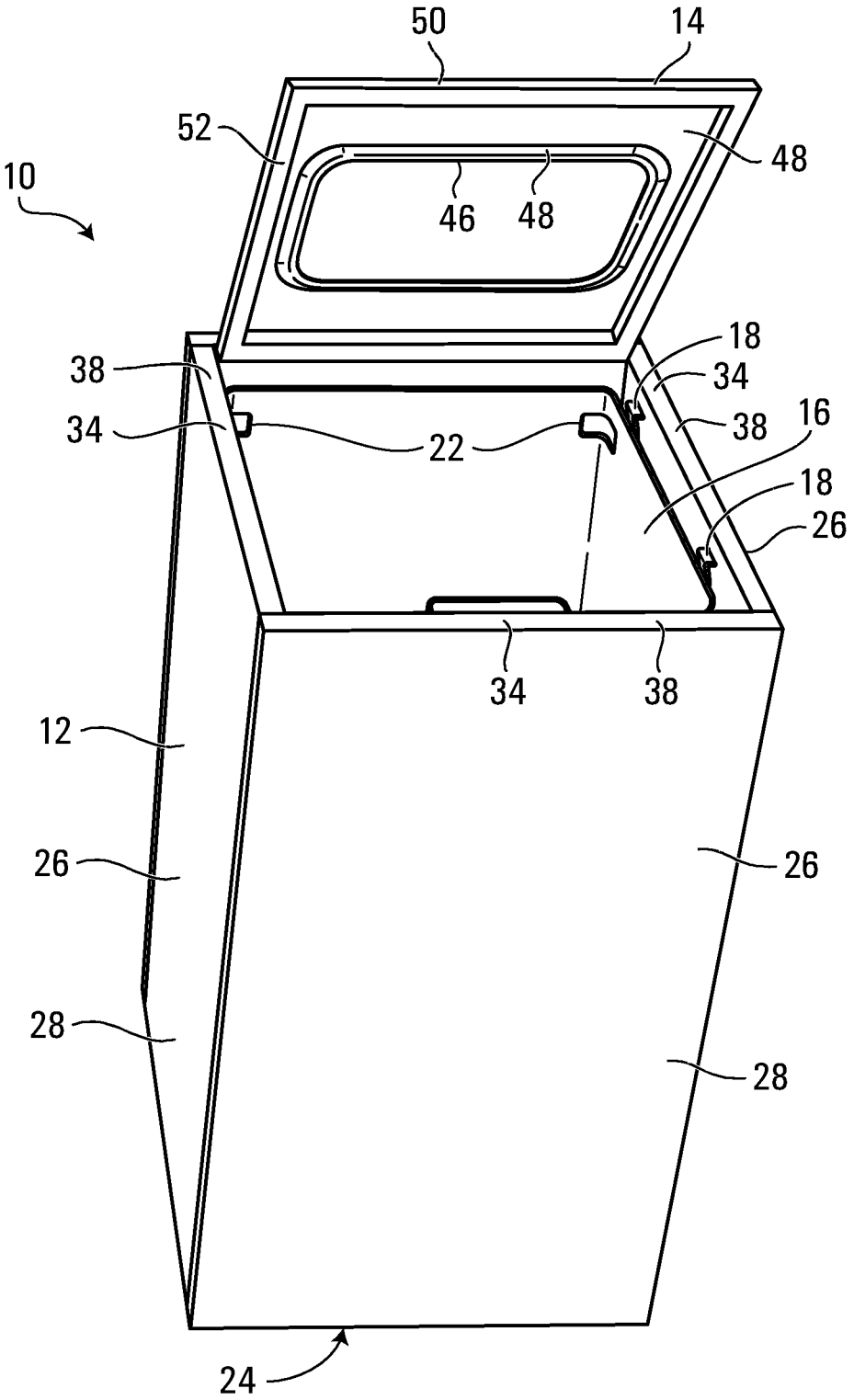
FIG. 7 is a perspective view of a container system including the container of FIG. 1 with the cover in a partially lifted position and the liner of FIG. 3 placed in a first position.

Generally, FIGS. 1 to 13 show an embodiment of a container system 10 and embodiments of components of the container system 10. The container system 10 is shown in FIGS. 7 and 9 and may be a waste or recycling container system for collecting waste and/or recyclables. The container system 10 may include a container 12 and a cover 14 as shown in FIGS. 1 and 2, a rigid liner 16 as shown in FIGS. 3 to 6 and one or more bag retention clips 18 as shown in FIGS. 10 to 13.

Figure 8:
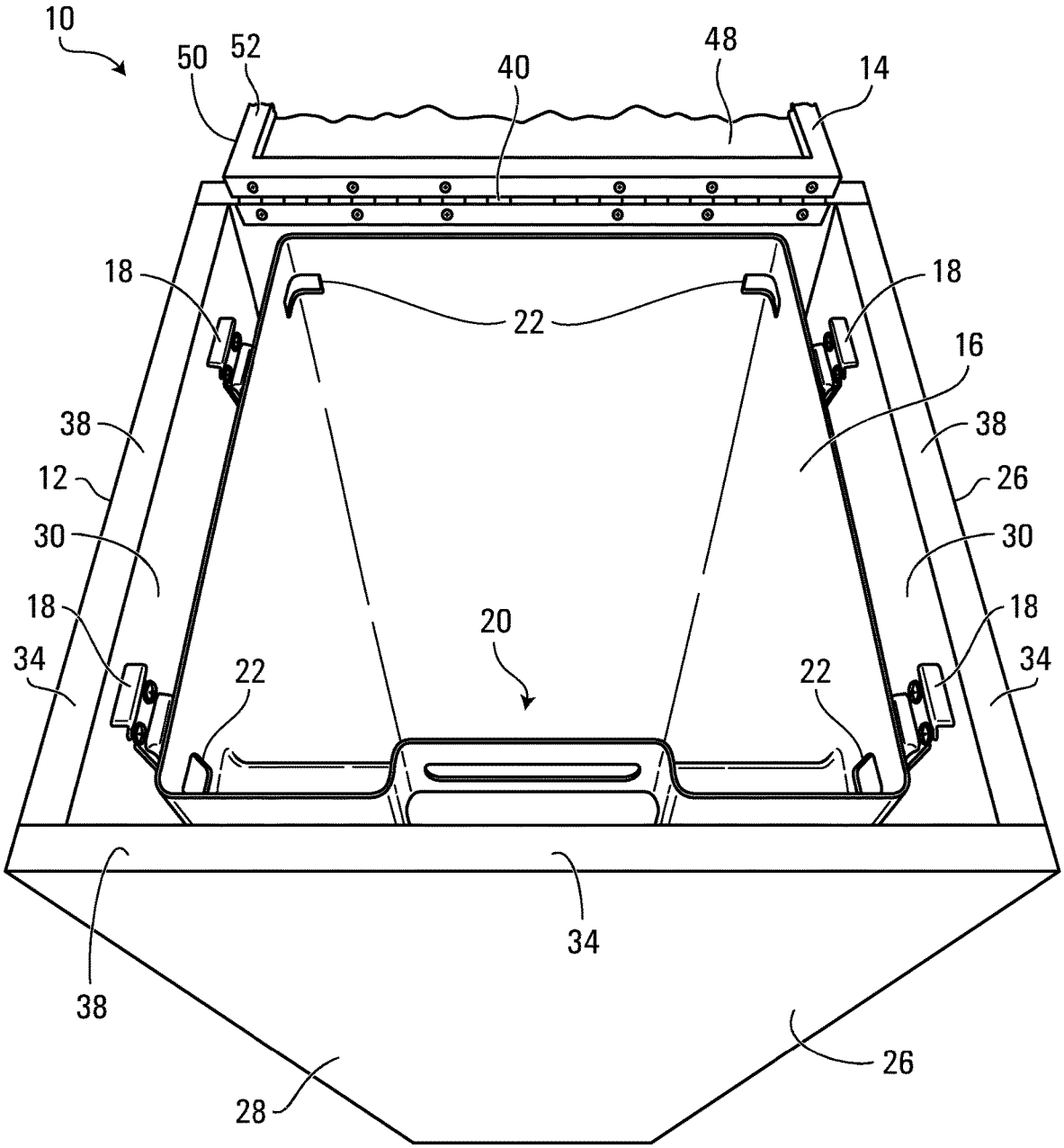
FIG. 8 is a top perspective view of the container system of FIG. 7 with the cover in the open position.
Figure 9:
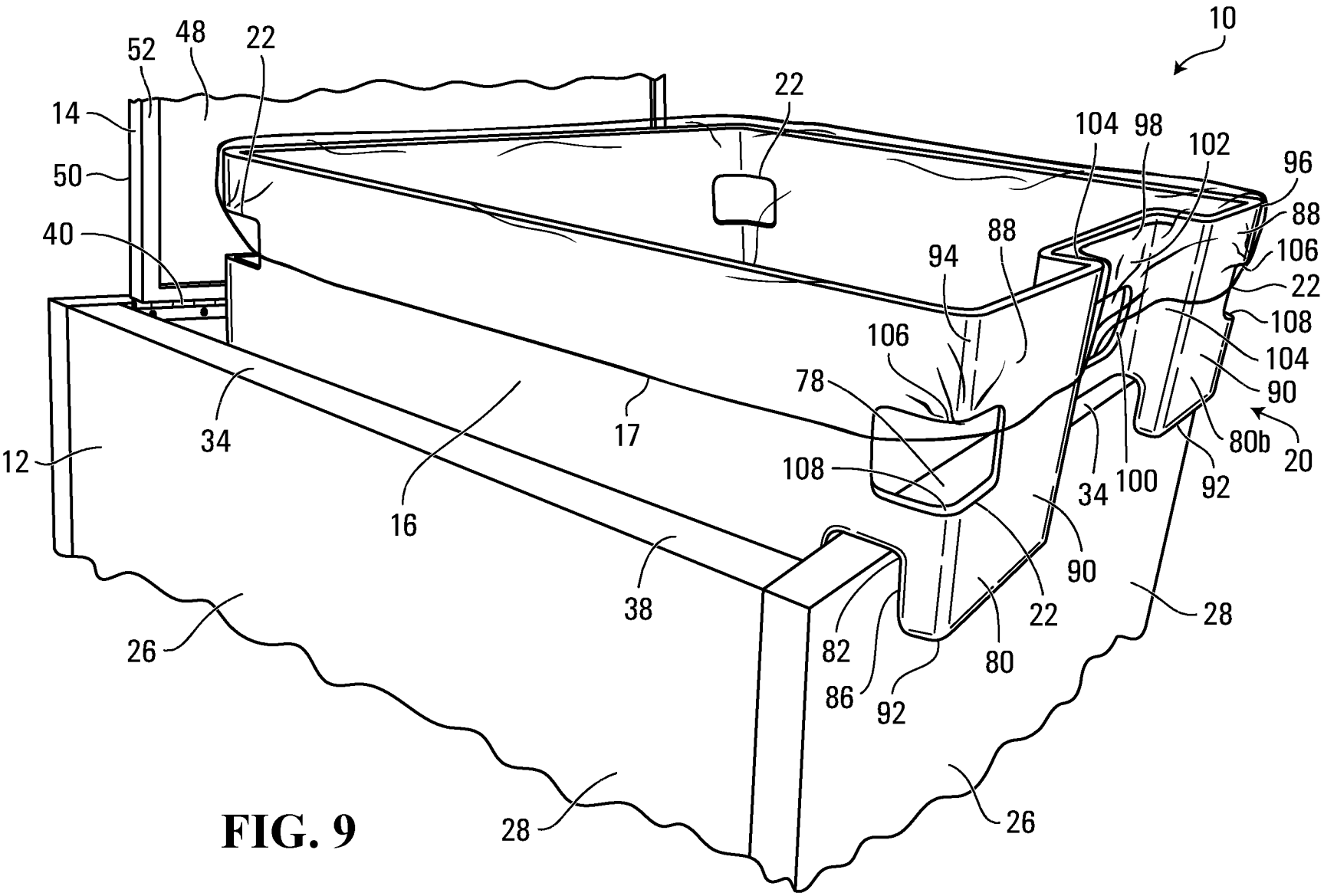
FIG. 9 is a left side perspective view of the container system of FIG. 7 with the liner in a second position and with a bag placed in the liner.
Figure 10:
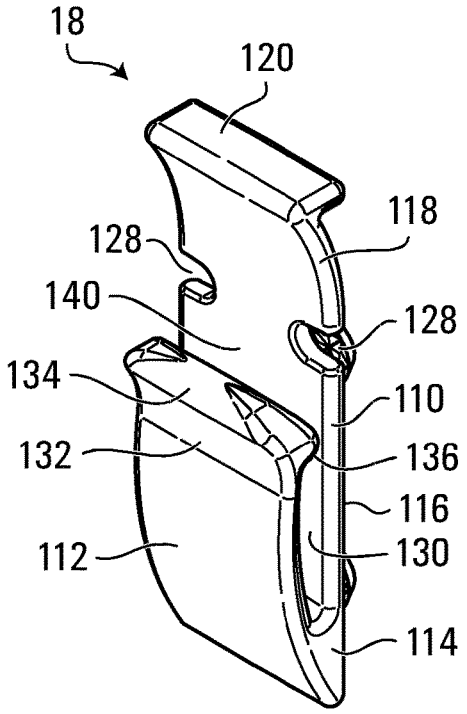
FIG. 10 is a perspective view of a bag retention clip according to an embodiment.
Figure 11:
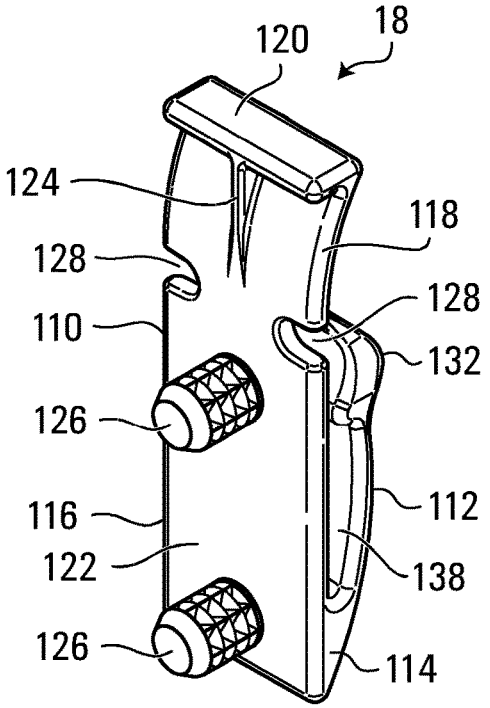
FIG. 11 is a rear perspective view of the bag retention clip of FIG. 10.
Figure 12:
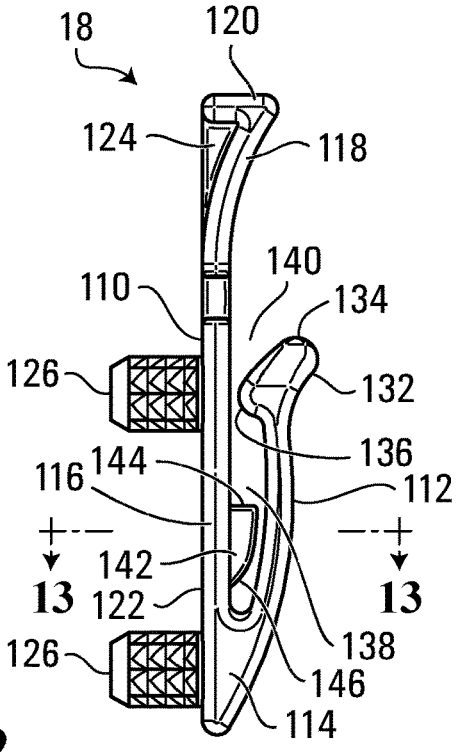
FIG. 12 is a left side view of the bag retention clip of FIG. 10.
Figure 13:
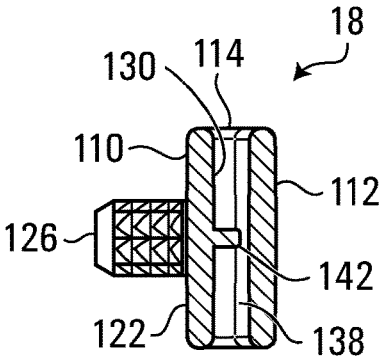
FIG. 13 is a cross-sectional view of the bag retention clip of FIG. 10 taken along line 13-13 in FIG. 12.

FIGS. 7 and 8 show the liner 16 in a first position in the container 12. FIG. 9 shows the liner 16 in a second position that is elevated with respect to the first position. Also, FIG. 9 shows a bag 17 that has been placed and retained in the liner 16. The liner 16 may be provided with a supporting structure 20 and one or more bag retention structures 22, which are embodied as bag retention cutouts, to aid in retaining the bag 17.

Figure 14:
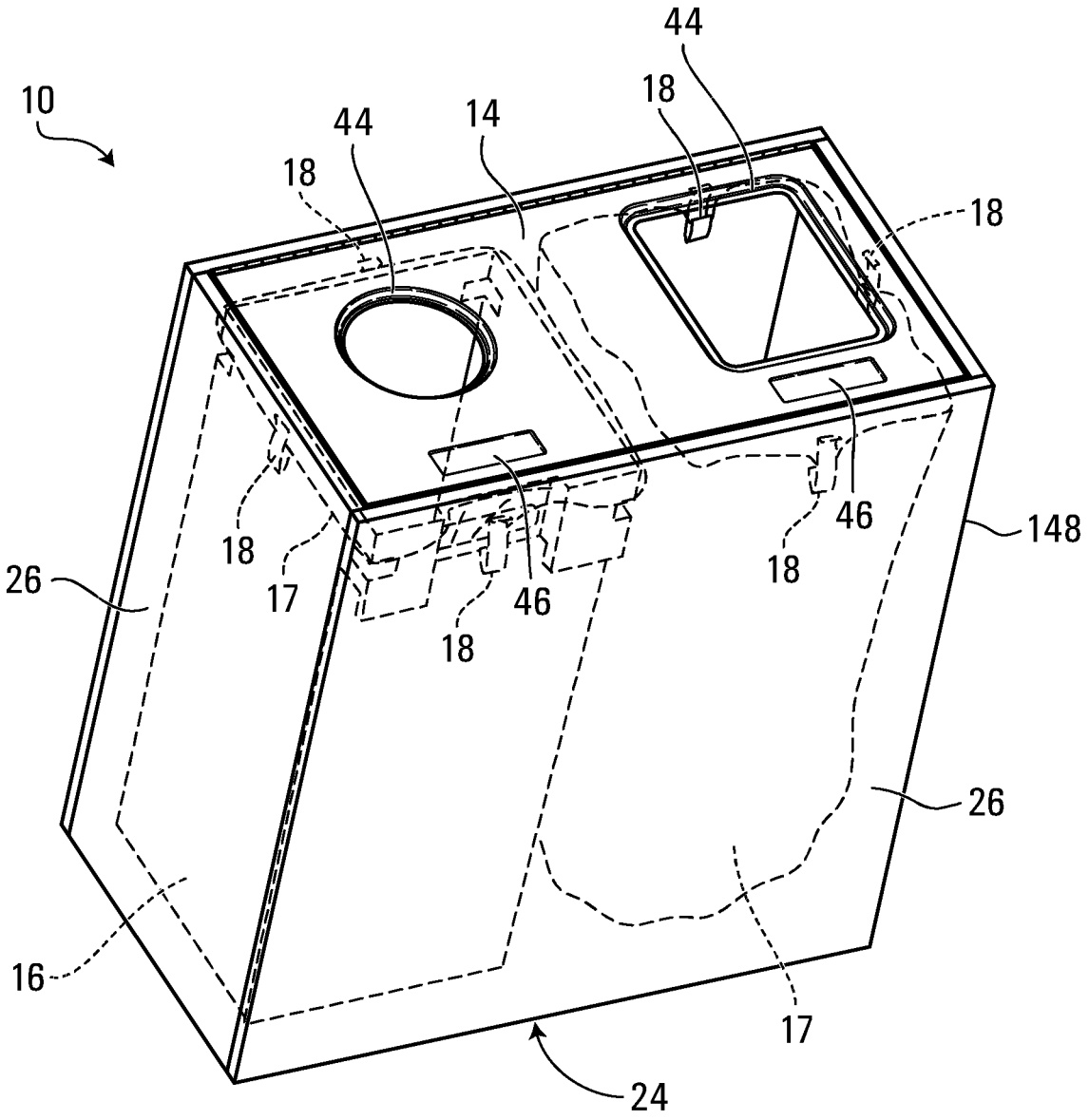
FIG. 14 is a perspective view of a container system according to another embodiment.
Figure 15:
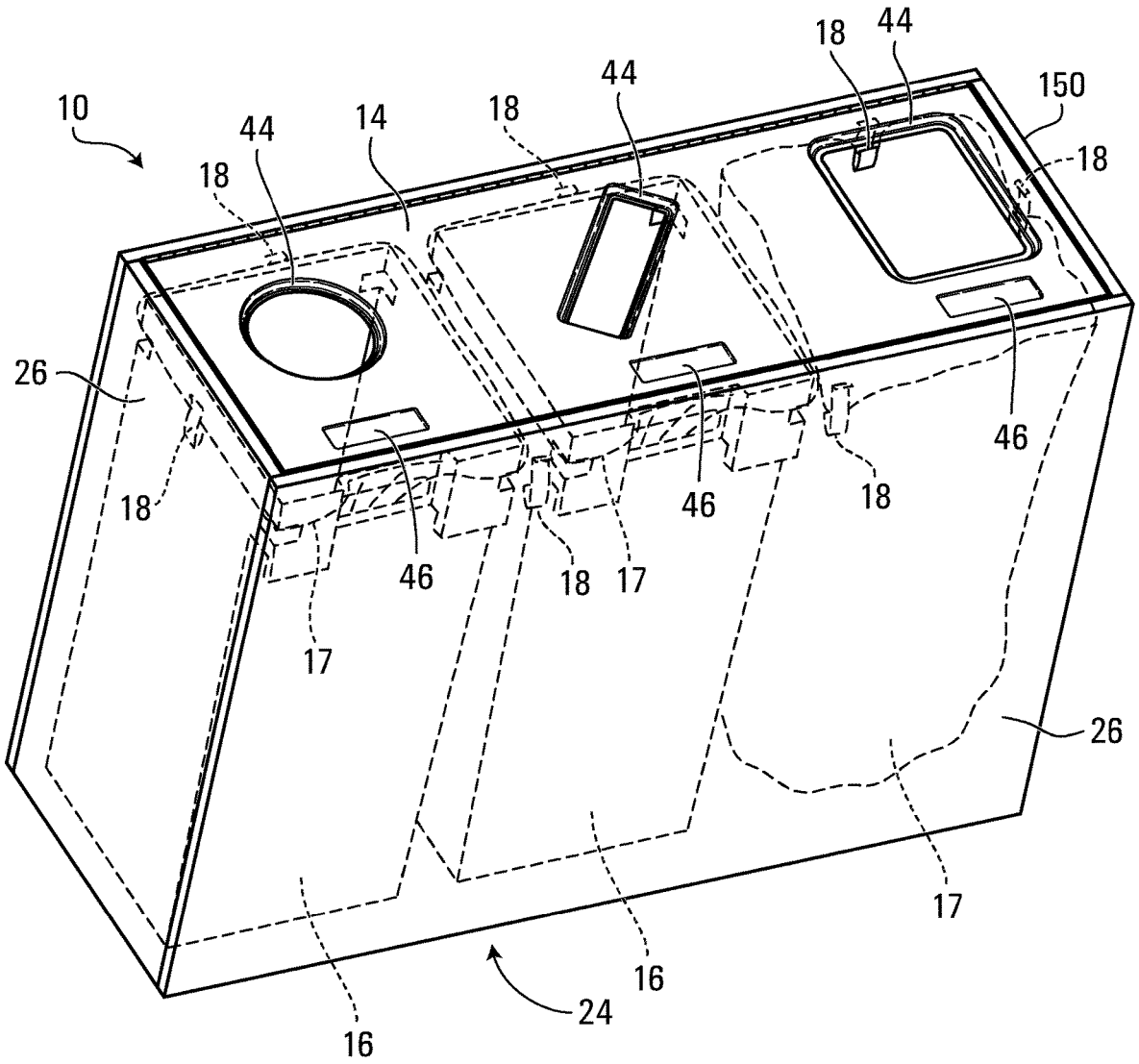
FIG. 15 is a perspective view of a container system according to yet another embodiment.

FIGS. 14 and 15 show further embodiments of the container system 10 as will be discussed below.

Figure 1:
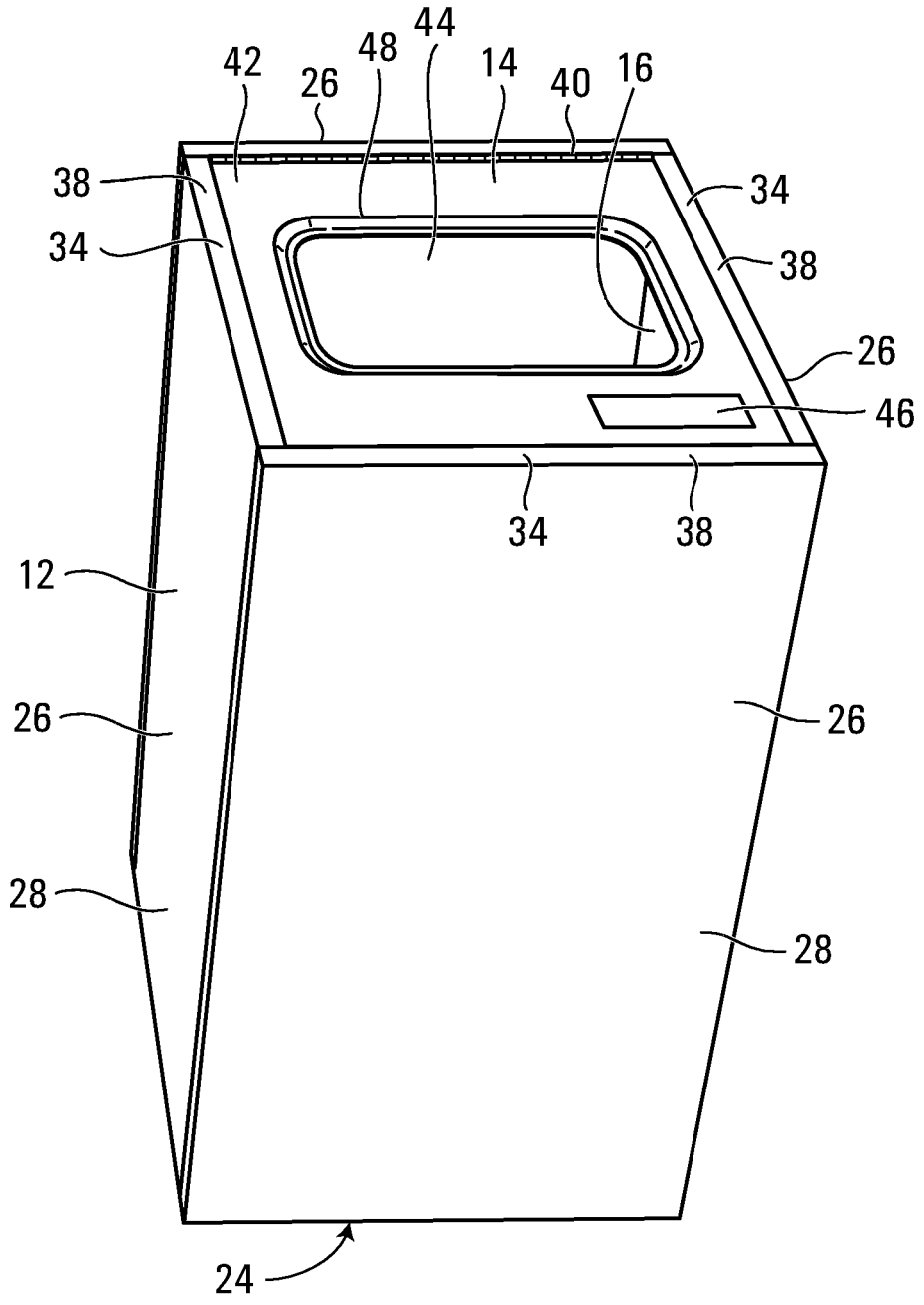
FIG. 1 is a front perspective view of a container according to an embodiment with a cover in a closed position.
Figure 2:
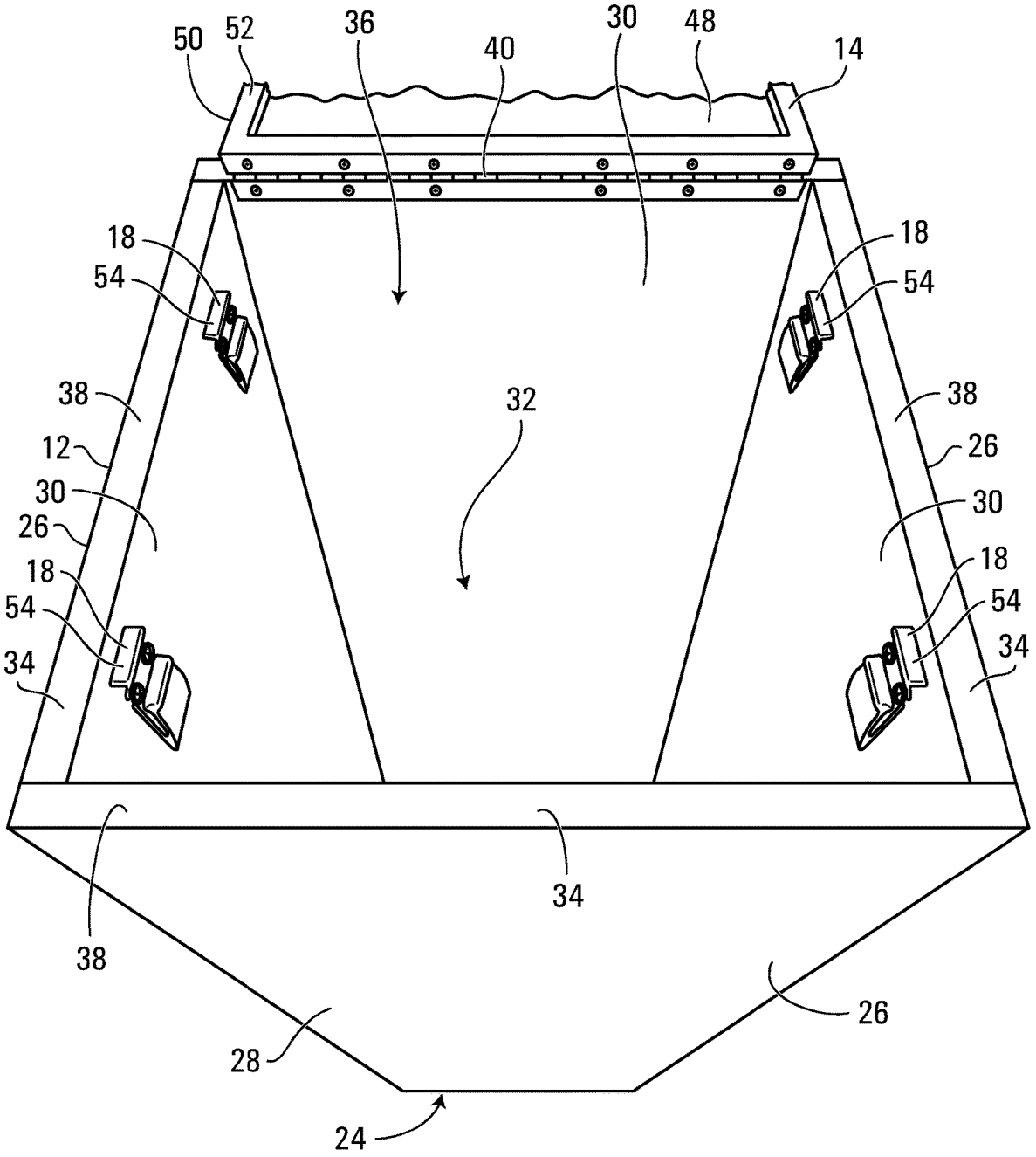
FIG. 2 is a top perspective view of the container of FIG. 1 with the cover in an open position.
Figure 3:
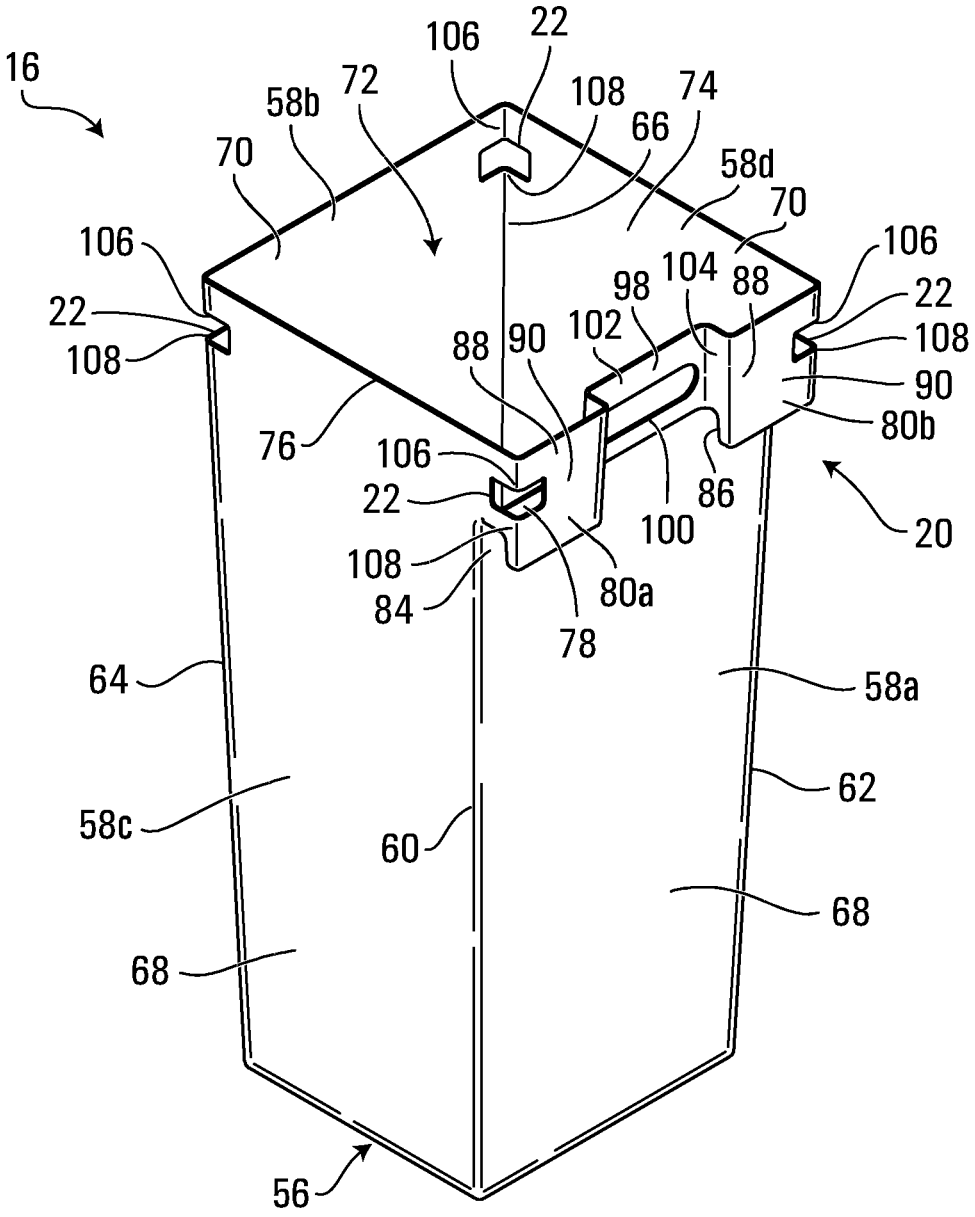
FIG. 3 is a perspective view of a liner according to an embodiment.
Figure 4:
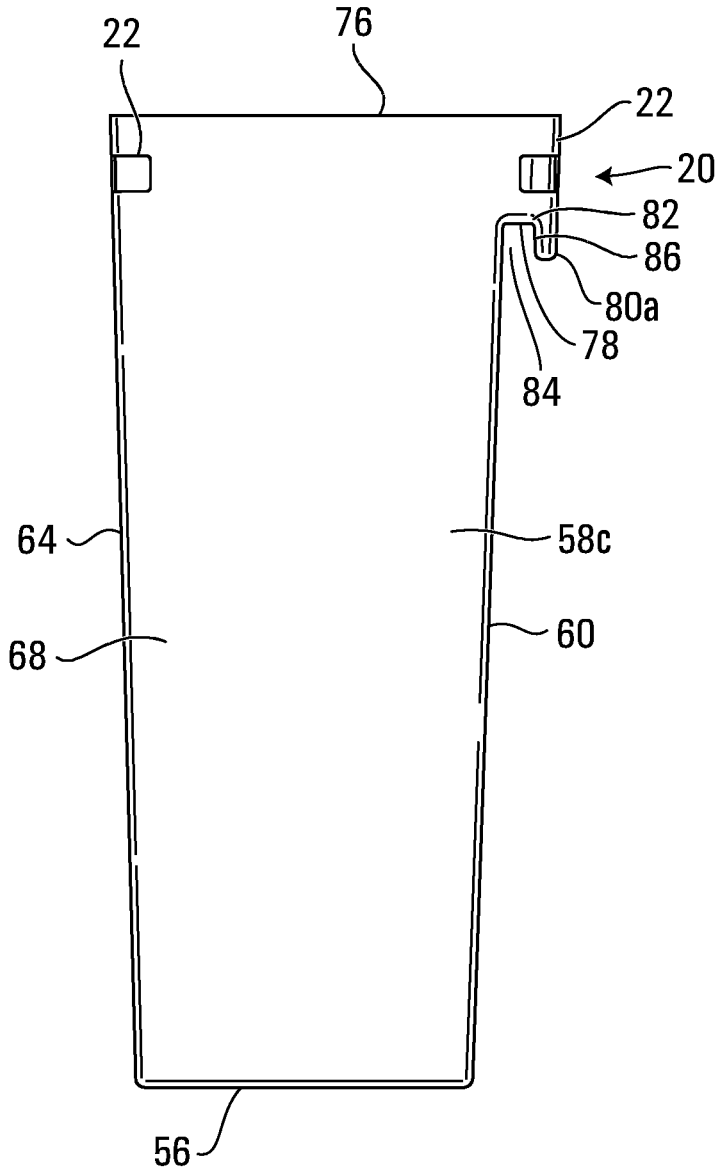
FIG. 4 is a left side view of the liner of FIG. 3.
Figure 5:
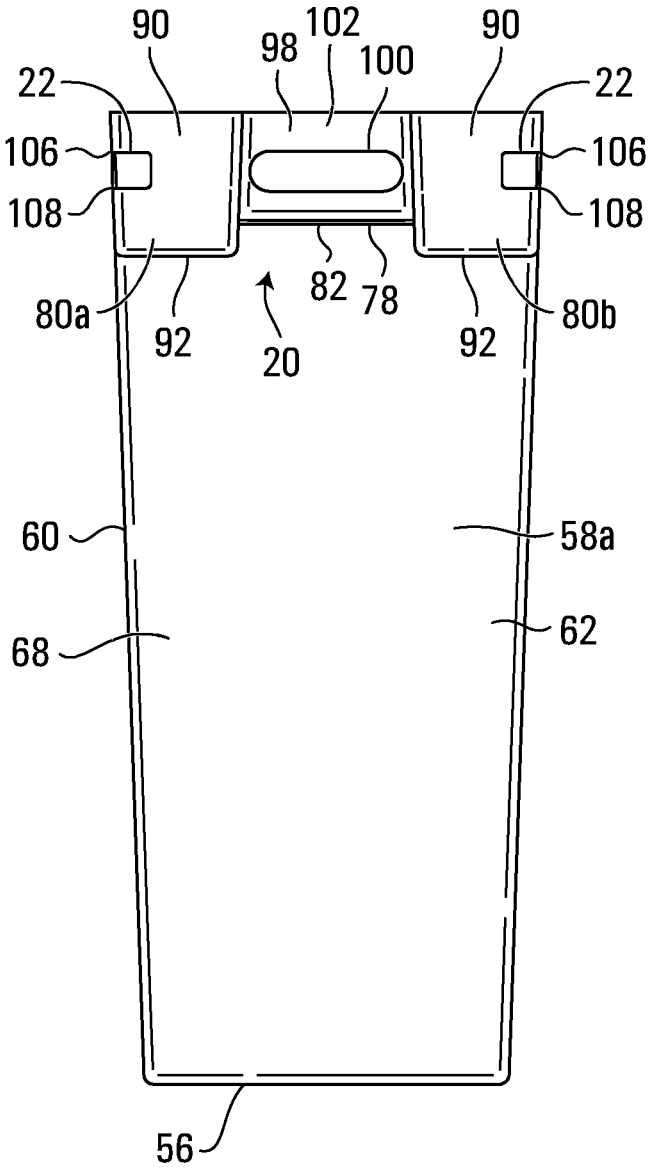
FIG. 5 is a front view of the liner of FIG. 3.
Figure 6:
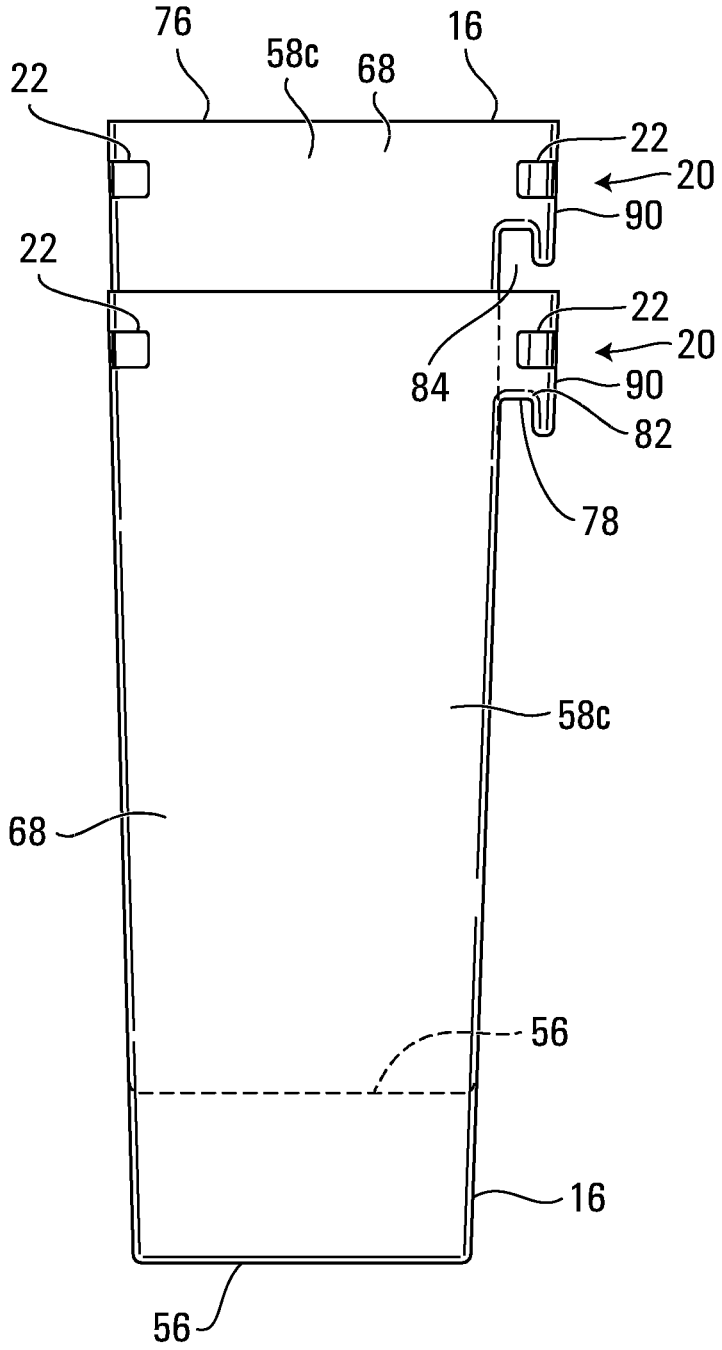
FIG. 6 is a left side view of the liner of FIG. 3 in a stacked, nesting arrangement with another and identical liner.

Referring now to FIGS. 1 and 2, the container 12 and cover 14 will be described. The container 12 has a base 24 and one or more container walls 26 extending upwardly from the base 24. In the embodiment shown, the base 24 is configured as a rectangular base wall and the container walls are four, generally rectangular container walls 26 arranged at right angles to each other, each container wall 26 extending upward from a respective side of the rectangular base wall to form a box-like structure with an open top. Each wall has an exterior surface 28 and an interior surface 30. The interior surfaces 30 of the container walls 26 together define a first interior space 32.

The base 24 may have the additional function of helping to ensure that the liner 16 is at the correct elevation in the first position. This may be achieved by having the base 24 positioned as desired above the bottoms of the container walls 26. Furthermore, the base 24 may be domed or recessed into the container 12, which may aid in providing stability to the container 12.

The term "base" is also meant to encompass embodiments other than the base wall embodiment described in reference to FIGS. 1 and 2. In some embodiments, the base 24 of the container 12 may also simply be a frame that supports the container walls 26. In yet other embodiments, the base 24 is merely comprised of the bottom edges of the one or more container walls 26. In some embodiments, the base 24 is configured so that the container 12 is partially or completely open at the bottom. In such embodiments the liner 16 may stand directly on the ground.

In some embodiments, there may be a different number of container walls 26 forming any suitable shape for the container 12. There may also be a single container wall 26, for example forming a circular cylinder or elliptical cylinder. Furthermore, the one or more container walls 26 may have differing heights and widths and may have a height that differs across its width or, in the case of a rounded container, along its circumference. The container 12 may have any suitable shape. It is not necessary for the container walls 26 to be planar. For example, the walls 26 may be concave or convex in one or more directions.

In the embodiment shown, the container walls 26 are configured as panels that are connected to each other. In other embodiments, the container walls may not be individual panels, but the entire container may be moulded from a single unitary piece of material, for example plastic or other suitable materials.

A rim 34, formed by an upper extent of the container walls 26, defines a first opening 36. The rim 34 has a rim profile that is determined by the profile of the upper extents of the container walls 26. For example, in the embodiment shown, the container walls 26 end in upper surfaces 38, which are substantially flat and meet the exterior and interior surfaces 28 and 30 of the walls 26 at substantially right angles. Thus, in the embodiment shown, the rim profile has the shape of an upside down "U" with right angles at the corners.

In some embodiments, the rim 34 has a different profile. For example, the rim 36 may be rounded. Different cross-sectional profiles are possible. In some embodiments, the profile of the rim 34 varies from location to location along the opening 36 of the container 12.

The cover 14 is hingedly attached to the container 12 with a hinge 40 along one of the container walls 26, in particular a back wall. The hinge 40 allows the cover 14 to pivot as the cover 14 is swung or lifted up and off the container 12. In FIG. 1, the cover 14 is in a closed position and covers the container opening 36. In FIG. 2, the cover 14 has been fully opened and a top surface 42 of the cover 14 rests on the upper surface 38 of one of the container walls 26.

Various means of connecting the cover 14 to the container 12 are possible. For example, in some embodiments, the cover 14 is hinged to the container 12 using two, spaced apart hinges instead of a single hinge running along the length of the cover. In other embodiments, the cover 14 is not hinged to the container 12 but is connected in a different manner that allows a user to lift the cover 14 off the container 12. In some embodiments, there may be an additional element, structure or mechanism provided that aids in keeping the cover 14 stationary in a partially lifted or raised position. In yet other embodiments, the cover 14 is not connected to the container 12 at all and is configured as a lid that is separable and removable from the container 12.

The cover 14 is sized so that its exterior dimensions match the dimensions of the first opening 36 in order to substantially cover the first opening 36. When the cover 14 is in the closed position, waste and/or recyclables are placed into the container 12 through an opening 44 defined in the cover 14. In the embodiment shown, the cover opening 44 is defined by a strip 46 of the cover 14 that is recessed from the top surface 42 of the cover 14 and a bevel 48 extends between the strip 46 and the top surface 42.

The top surface 42 of the cover 14 is substantially flat so that, when the cover 14 is in the closed position, the top surface 42 is substantially flush with the upper surfaces 38 of the container walls 26.

The cover 14 also includes a label recess 46 on the top surface 42 for receiving a label or other identifier that indicates what type of waste or recyclable material the container 12 is intended for.

Opposite the top surface 42, the cover has a bottom surface 48 that faces the interior space 32 of the container 12. A lip 50 extends around a perimeter of the bottom surface 48. The lip includes a bottom resting surface 52 on which the cover 14 rests in the closed position.

In the embodiments where the container 12 is shaped and configured differently than in the embodiment shown, the cover 14 may also be shaped and configured differently to correspond to the opening 36 of the container 12. Even where the container 12 is embodied as shown, different shapes and configurations for the cover 14 are also possible. For example, the cover 14 may not be flush with the upper surfaces 38 of the container walls 26. The cover 14 may have any suitable and desirable appearance and configuration.

The opening 44 in the cover 14 may correspond to the type of waste or recyclables that are to be placed into the container 12. For instance, a round cover opening 44 might indicate glass and/or plastics, while a slit-shaped opening 44 might indicate paper-based materials. Moreover, in yet other embodiments, the cover 14 may not include a cover opening 44 at all so that the cover 14 must be lifted or removed from the container 12 in order to place waste or recyclables into the container 12.

The label recess 46 is not necessarily present in all embodiments or it may be at a different location, for example on one of the container walls 26 and not the cover 14. The cover 14 may also be used to indicate the waste and/or recyclables intended to be placed into the container 12. For example, the cover 14 may be coloured to indicate the type of recyclables: blue for plastics, black for paper recyclables etc.

It is noted that the cover 14 is not necessarily present in all embodiments of the container system 10. If the cover 14 is not present, the container 10 and the liner 16 remain uncovered during use.

As seen in FIG. 2, the bag retention clips 18 are connected to the container walls 26 so as to be provided on the interior surfaces 30. The bag retention clips 18 may serve two functions. First, when the liner 16 is not present, a bag (not shown in FIG. 2) inserted into the interior space 32 of the container 12 may be held in place using the bag retention clips 18, as will be discussed in further detail below. Second, support surfaces 54 at the top of the bag retention clips 18 act as a ledge on which the support resting surface 52 of the cover 14 rests when the cover 14 is in the closed position. The bag retention clips 18 and their function will be described in further detail below.

The container 12 and the cover 14 may be made of a variety of materials or combination of materials and using a variety of methods. For example, the container 12 may be rotation moulded. The container 12 may be made of metal or plastics, with different finishes as desired. Similarly, the cover 14 may be made of a variety of material and using a variety of methods. The materials for the container 12 and cover 14 may be chosen to create a desired appearance, such as brushed stainless steel or a wooden veneer-like appearance.

Referring now to FIGS. 3 to 6, an embodiment of the liner 16 will be described in more detail. The liner 16 includes a liner base 56 and one or more liner walls 58*a* to 58*d* extending upwardly from the base 56. In the embodiment shown, the base 56 is configured as a rectangular base wall and the liner includes four walls 58*a* to 58*d* arranged at generally right angles to each other, each wall extending upwardly from a respective edge of the rectangular base. In particular, the liner includes a front wall 58*a*, a back wall 58*b* and two side walls 58*c* and 58*d*. The sidewalls 58*c* and 58*d* meet the front wall 58*a* at first and second edges 60 and 62, respectively. The sidewalls 58*c* and 58*d* meet the back wall 58*b* at third and fourth edges 64 and 66, respectively.

The liner walls 58*a* to 58*d* are configured so that the liner 16 tapers and has a "draft angle" i.e. each of the liner walls 58*a* to 58*d* is inclined at angles with respect to the horizontal. This may allow the liner 16 to be stacked in a nested arrangement with another, identical liner 16 as shown in FIG. 9. The liner 16 is dimensioned so that the supporting structures 20 do not nest and there is sufficient room to pull up them apart. The draft angle or taper of the liner 16 may also allow the liner to be removed from the rotation mould more easily than if the liner had no draft angle.

In the embodiment shown, the front wall 58*a* is inclined forward at an angle of 88° with the horizontal, the back wall 58*b* is inclined backwards at an angle of 88.5° with the horizontal, and sidewalls 58*c* and 58*d* are inclined to either side at an angle of 88° with the horizontal.

Similar to the base 24 of the container 12 discussed above, the base 56 of the liner 16 is not necessarily configured as a base wall in all embodiments. In some embodiments, the base 56 of the liner 16 is merely a frame to support the liner walls 58*a* to 58*d*. The liner 16 may be open at the bottom, in which case the bag placed in the liner 16 may or may not extend past the bottom of the liner 16.

The liner 16 may also have a different shape and configuration than the embodiment shown. The liner 16 may have a different number of walls and may have a single wall. For example, the liner 16 may be configured as a circular or elliptical cylinder. The liner 16 may be configured to correspond to the shape of the container 12. Thus, for example, where the container 12 is configured as a circular cylinder, the liner 16 may be configured as a circular cylinder as well.

In the embodiment shown, the liner walls 58*a* to 58*d* have substantially flat exterior and interior surfaces 68 and 70. The interior surfaces 70 of the liner walls 58*a* to 58*d* define a second interior space 72. A second or liner opening 74 is defined by a liner rim 76 that is formed by an upper edge of the back wall 58*b*, upper edges of the side walls 58*c* and 58*d* and an upper edge of the supporting structure 20.

The supporting structure 20 is provided on one of the liner walls 58*a* to 58*d*. In the embodiment shown, the supporting structure 20 is provided at the top of the front liner wall 58*a*. The supporting structure 20 includes a cantilever 78 that extends substantially horizontally from the front wall 58*a* and first and second anchor portions 80*a* and 80*b* that extend downwardly from a distal end 82 of the cantilever 78. The cantilever 78 extends across a width of the front wall 58*a* such that it forms a shelf or ledge across the width of the front wall 58*a*.

The cantilever 78 does not necessarily extend across the entire width of the front wall in all embodiments. The cantilever 78 may extend across only a portion of the width. In some embodiments, the cantilever 78 comprises two, discontinuous cantilever portions that extend in parallel from the front wall, each with an anchor portion.

A channel 84 is formed between the anchor portions 80*a* and 80*b* and the front wall 58*a*, the channel 84 having a channel profile. Specifically, each anchor portion 80*a* and 80*b* includes a channel wall 86 that is generally parallel with and spaced apart from the front wall 58*a* and extends downwardly from the end 82 of the cantilever 78, the channel profile being defined by the front wall 58*a*, the cantilever 78 and the channel wall 86.

The channel profile may be complementary or substantially complementary to the rim profile of the container rim 34. This may facilitate the liner 16 being supported in the second position by the supporting structure 20 resting on the rim 34. Specifically, the liner 16 may have a tendency, due to its weight, to tip backwards and slide back into the container 12 when resting on the rim 34. However, complementary rim and channel profiles may allow for partial positive form locking or mating, which counteracts the tendency of the liner 16 to tip backwards.

As best seen in FIG. 9, each anchor portion 80*a* and 80*b* also includes a guiding wall 88 having a planar, guiding surface 90 opposite the channel wall 86 and facing away from the front wall 58*a*. The guiding wall 88 and the channel wall 86 meet at a nose tip portion 92 at a distal end of each anchor portion 80*a* and 80*b*. As noted above, an upper edge of each guiding wall 88 forms part of the liner rim 76.

In the region of the supporting structure 20, sidewalls 58*c* and 58*d* extend past the respective first and second edges 60 and 62 above the front wall 58*a* to meet the respective guiding wall 88 at fifth and sixth edges 94 and 96, respectively.

The placement of the cantilever 78 and anchor portions 80*a* and 80*b* is not restricted to the embodiment shown. Any suitable configuration for the cantilever 78 and anchor portions 80*a* and 80*b* that allow the liner to be supported in the second position is possible. For example, the supporting structure 20 may have a cantilever 78 but no anchor portions.

Moreover, the term "supporting structure" is intended to cover any suitable structure, combination of structures, mechanisms or means that allow the liner 16 to be supported in the second position, elevated with respect to the first position, on a resting portion of the container 12. Similarly, the term "resting portion" is also intended to cover any suitable structure, combination of structures, mechanisms or means on which the liner 16 may be supported in the second position, elevated with respect to the first position. In some embodiments, the supporting structure 20 may be a portion of the liner and not a separate structure provided on or connected to the liner. For example, in some embodiments, the supporting structure 20 may simply be a portion of one of the liner walls 58*a* to 58*d* or the base 56 and the corresponding resting portion on which the liner rests is a ledge provided in the interior 32 of the container 12. In yet other embodiments, the cantilever 78 may be provided on the liner 16 and corresponding, upward pointing anchor portions 80*a* and 80*b* may be provided as the resting portion on the container 12.

The liner 16 may further include a handle 98. In the embodiment shown, the handle 98 is provided at a midpoint along a width of the cantilever 78. The handle 98 is formed by a handle cutout 100 provided in a handle wall 102 that extends upwardly from the distal end 82 of the cantilever 78. A user may grip the portion of the handle wall 102 above the handle cutout 100 as the handle 98. The handle wall 102 is recessed from the guiding walls 88. Connecting walls 104 extend from either end of the handle wall 102 to each guiding wall 88. The upper edges of the handle wall forms part of the liner rim 76 as well.

The positioning of the handle 98 along the midpoint of the width of the cantilever 78, may allow for even weight distribution when the liner 16 is being lifted using the handle 98, as described further below. Furthermore, the handle wall 102 being recessed from the guiding walls 88 provides a space between the handle wall 102 and the walls 26 of the container 12. This space may provide clearance for a user's hand to grip the handle 98 when the liner 16 is in the first position in the container 12.

In some embodiments, the handle 98 is not present or is not formed by a handle cutout 100, but extends outwardly or inwardly from one of the one or more liner walls 58*a* to 58*d*. If present, the handle 98 may be placed in any suitable location. In embodiments where there is no handle wall 102, the guiding walls 88 of each anchor portion 80*a* and 80*b* may connect to form a single guiding wall 88. In other embodiments, there may be two handles 98, one on each side of a single, central anchor portion.

The liner 16 further includes one or more bag retention structures 22 provided on the one or more liner walls 58*a* to 58*d*. In the embodiment shown, the bag retention structures 22 are formed as bag retention cutouts or apertures 22. Specifically, in the embodiment shown, there are four bag retention cutouts 22. One bag retention cutout 22 extends across each of the third, fourth, fifth and sixth edges 64, 66, 94, and 96.

In the embodiment shown, the bag retention cutouts 22 are rectangular such that, by extending across an edge, two jutting corners are formed in each cutout, a top jutting corner 106 and a bottom jutting corner 108.

As noted above, the bag retention structures or cutouts 22 are provided on the liner 16 such that, when the liner 16 is placed in the second position, the bag retention structures 22 are above the opening 36 of the container 12. Specifically, in the embodiment shown, the bag retention cutouts 22 are provided above the channel 84, particularly above a height of the cantilever 78 as measured from the liner base 56.

In the embodiment shown, there are four bag retention structures 22; however, a different number is possible. There may be more or fewer than four and there may even be but one.

The bag retention cutouts 22 may be placed at different locations on the liner and not necessarily at the locations shown. Some or all of the bag retention cutouts 22 may not extend across an edge.

Furthermore, in embodiments with more than one bag retention cutout 22, the bag retention cutouts 22 need not necessarily all have the same shape or configuration. In some embodiments, the bag retention cutouts 22 may also be provided with additional features to aid retention of the bag. For example, the edge of the bag retention cutouts 22 may be serrated or have other gripping features that may resist the bag from being pulled out of and/or over the bag retention cutouts 22.

Other embodiments of the bag retention structures 22 are possible. The bag retention structures 22 are not necessarily formed as cutouts. In some embodiments, the bag retention structures 22 may comprise a hook or other protrusion that protrudes from the exterior of the liner 16. This hook or protrusion may serve a similar function as the upper jutting corner 106 in the embodiment shown. In other embodiments, there may be a combination of different types of bag retention structures 22. For example, the liner 16 may be provided with both bag retention cutouts and hooks or protrusions.

The liner 16 may be a rigid liner. The term "rigid" is intended to encompass liners 16 that have sufficient structural integrity so as to fulfill the functions described herein. Specifically, the term rigid is intended to encompass all liners 16 that substantially maintain their shape when placed in the first and second positions in the container, even when subject to forces caused by their own weight and/or the weight of waste or recyclables. Nonetheless, the term rigid does not exclude liners 16 that have some flexibility or are otherwise deformable.

The liner 16 may be made of a variety of materials and using a variety of methods. The liner 16 may be moulded or formed from a unitary piece of suitable material or combination of materials, including plastic. For example, the liner 16 may be rotation moulded. The liner 16 may be made of metal or plastics, or combinations thereof, with different finishes as desired. The materials for the liner 16 may be chosen to create a desired appearance.

It is noted that providing the bag retention structures 22 and the handle 98 as cutouts may simplify manufacturing of the liner 16. Particularly, in embodiments where the liner 16 is formed from a single, unitary piece of material, such as plastic, the cutouts for the bag retention structures 22 and the handle 98 can be provided by machining after the liner 16 has been removed from the mould. This may allow for a relatively simple mould and may allow certain types of moulding, such as rotation moulding, to be used to form the liner 16. Also, providing the bag retention structures 22 and the handle 98 as cutouts may aid in avoiding having to attach and assemble additional features, such as a protruding handling, after moulding.

As can be seen in a comparison of FIGS. 8 and 9, the liner 16 is capable of being placed in the interior space 32 of the container 12 in at least a first position and a second position.

As shown in FIG. 8, in the first position, the liner 16 is fully inserted into the container 12 such that the cover 14 can be fully closed and supported by the bag retention clips 18. In the embodiment shown, the liner 16 rests on or is supported by the base 24 of the container 12. However, in embodiments where the container 12 is open at the bottom, the liner 16 may rest on the ground or floor.

As shown in FIG. 9, in the second position, the liner 16 is elevated with respect to the first position. The liner 16 is supported by means of the supporting structure 20, the supporting structure 20 resting on a corresponding resting portion of the container 12, namely, in the embodiment shown, the rim 34 of the container 12. The second position is elevated with the respect to the first position such that the bag retention structures 22 are above the opening 36 of the container 12, while in the first position they are below the opening 36.

Thus, the liner 16 may improve the ergonomic handling and design of the container system 10 by allowing the bag 17 inserted in the liner to be changed or replaced more easily. Furthermore, the liner may also help to retain and capture moisture if the bag 17 used to collect the waste or recyclables tears or rips. Without the presence of the liner, where the bag 17 is held by the bag retention clips 18 as described below, tearing or ripping of the bag 17 may lead to moisture damaging the container 12.

The use and function of the liner 16 according to an embodiment will now be described. The bag 17 (shown transparent in FIG. 9 and not shown in FIGS. 7 and 8) to collect waste and/or recyclables can be placed into the liner 16. Such a bag could be, for example, a plastic garbage bag that is known to those skilled in the art. After being filled with waste and/or recyclables the bag could be disposed of and a new bag inserted.

When being inserted into the liner 16, the opening of the bag 17 is draped over the liner rim 76 to retain the bag 17 in the liner 16. The bag 17 may be dimensioned so that draping the bag opening over the liner rim 76 causes the material of the bag 17, such as plastic, to stretch. Tension formed in the bag 17 due to the stretching may aid in retaining the bag in place by "gripping" the upper parts of the liner 16.

The bag 17 may also be dimensioned so that the bag 17 is draped loosely over the liner rim 76 without the need for stretching the bag 17. In such cases, excess bag can be gathered so that the bag 17 is pulled taut around the liner rim 76.

To aid retention of the bag 17, the bag opening is draped over the liner rim 76 to such an extent that the bag descends over all or a part of the bag retention structures 22. In the embodiment shown, pulling the bag 17 taut around the liner rim 76 may cause portions of the bag 17 to enter the bag retention cutouts 22 and to get caught on the upper jutting corners 106 in each bag retention cutout 22. Thus, when waste or recyclables are placed into the bag 17 and their weight has the tendency to drag the bag 17 into the liner 16, the jutting corners 106 aid in retaining the bag 17 in place by acting as hook-like formations that grip the bag 17 and prevent it from sliding into the liner 16.

In cases where excess bag is gathered to pull the bag 17 more taut over the liner rim 76 and around the upper parts of the liner 16, the excess bag may be secured to help maintain the tautness. The excess bag may be tied into a knot or wrapped around the handle 98, if present. In embodiments where the handle 98 is formed by the handle cutout 100, the excess bag may be gathered and inserted from outside the liner 16 through the handle cutout 100 into the interior space 72 of the liner 16, as shown in FIG. 9. Doing so may further aid to maintain the grip of the bag 17 on the upper parts of the liner 16.

To place a bag in the liner 16, a user would first lift the cover 14 of the container 12 up and pivot it around the hinge 40 until the container 12 is sufficiently uncovered. The user would then grab the handle 98 and pull up on the liner 16 to raise the liner 16 out of the first position. Because of the weight of the liner 16 and the position of the handle 98 at the front of the liner 16, the liner 16 may tip forward towards the front of the container 12 while being raised. When tipped forward and being raised, each of the guiding walls 88 would make contact with the front wall 26 and/or rim 34 of the container and slide along the front wall 26 of the container 12 until the anchor portions 80*a* and 80*b* clear the rim 34. The user could then let the liner 16 down slightly so that the rim 34 of the liner 16 enters the channel 84 and the liner 16 is supported on the rim 34 in the second position, with the ledge formed by the cantilever 78 resting on the rim 34. In the second position, the anchor portions 80*a* and 80*b*, and/or the channel walls 86, may prevent the liner 16 from tipping backwards and sliding back into the container 12 due to the effect of gravity.

In the embodiment shown, the anchor portions 80*a* and 80*b* are provided symmetrically about the handle 98. The placement of the handle 98 along the midpoint of the width of the cantilever 78 and the symmetrical distribution of the anchor portions 80*a* and 80*b* may allow for an even weight distribution and balanced, ergonomic handling of the liner 16. For example, due to the placement of the handle 98, it may be possible for a user to lift the liner 16 with only one hand instead of requiring two hands.

While the liner 16 is in the second position, the user may be able to more readily access the bag retention structures 22 because the bag retention structures 22 are above the opening 36 of the container 12. Similarly, the user may be able to more readily access any excess of the bag 17 that was gathered to tighten the bag 17 around the upper parts of the liner 16. In the case of replacing an existing bag, the user would then loosen the bag 17 so it can be removed from the liner 16 and dispose of the bag 17. A new, empty bag 17 could then be placed into the liner 16 and retained as described above.

After an empty bag 17 is placed in the liner 16 and retained, the user would then lift the liner 16 out of the second position, lower it back into the container 12 into the first position and close the cover 14 on the container 12.

While the usage and function of the container system 10 and liner 16 have been described with reference to the embodiment shown in the drawings, the usage and function of the container system 10 and liner 16 may be adapted as necessary to different embodiments of the liner 16 and container 12. For example, if no handle 98 is present, a user may lift the liner 16 by gripping one or more of the walls 58*a* to 58*d* of the liner 16 or using some other means. For example, in some embodiments the liner 16 may be provided with protrusions on one or more sides for lifting the liner 16. Similarly, depending on the embodiment of the supporting structure 20, a user may place the liner 16 into the second position in a manner different than described above.

Referring now to FIGS. 10 to 13, an embodiment of the bag retention clips 18 will be described in more detail. The bag retention clip 18 includes a back 110 and a tongue 112 that meet at a flexible, resilient joint or elbow 114. The back 110 has a substantially vertical portion 116 which extends into a curved portion 118 that curves laterally away from the vertical portion 116. A shelf 120 extends from the end of the curved portion 118 perpendicularly to the vertical portion 116 and away from the tongue 112. The shelf 116 does not extend further than a back surface 122 of the vertical portion 116. A rib 124 is provided underneath the shelf 120 for stability.

For attaching the bag retention clips 18 to the container 12, two plugs 126 extend from the back surface 122 of the vertical portion 116. The plugs 126 can be inserted into corresponding apertures (not shown) in the walls 26 of the container 12. Furthermore, the bag retention clips 18 may be screwed into place using screws that pass through two symmetrically positioned screw indents 128 that are formed on opposite, lateral side of the back 110 in the region where the vertical portion 116 transitions into the curved portion 118.

The tongue 112 is formed as a curved tab that extends from the resilient joint 114 along a concave path in a plane substantially normal to a vertical front surface 130 of the back 110. The tongue 112 culminates in a head 132 that has a rounded top 134 and a rounded, internal edge 136 that faces the front surface 130 of the back 110 and juts out from the head 132.

A bag retaining space 138 that is open on opposite lateral sides of the bag retention clip 18 is formed between the tongue 112 and the back 110. A mouth 140 is defined by the space between the head 132 and the back 110. Due to the curvature of the head 132, the mouth 140 narrows towards the bag retaining space 138.

A vertically oriented, wedge shaped fin 140 is provided on the front surface 130 inside the bag retaining space 138 and extends in a plane normal to the front surface 130. The fin 142 has a substantially horizontal top edge 144 and a curved front edge 146 that extends from the top edge 144 to the front surface 130.

As noted above, the bag retention clips 18 may serve two functions. First, when the cover 14 is closed, the cover 14 rests on and is supported by the support surface 54 on the top of the shelf 120. Second, in cases where the liner 16 is not present, the bag retention clips 18 may be used to retain a bag in place in the container 12, may aid in maintaining the opening of the bag spread apart and prevent the top of the bag from being dragged down into the container 12 when waste or recyclables are placed into the bag.

To retain a bag with the bag retention clips 18, the bag would be inserted into the container 12 and the edge of the bag defining the opening of the bag would be inserted into the bag retaining space 138 of each bag retention clip 18. To do so, a user would slide the bag edge over the head 132 of the tongue 112, causing the tongue 112 to flex away from the back 110 and thereby widen the mouth 140 and entrance to the bag retention space 138. The user would then slide the bag edge down into the bag retention space 138 so that the bag edge and any excess bag material pushed into the bag retention space 138 is wedged between the tongue 112 and the bag, as well as between the tongue 112 and the front edge 146 of the fin 142. Depending on the amount of bag material pushed into the bag retention space 138, the tongue 112 may remain in a partially flexed position while the bag is being retained due to the buildup of bag material in the bag retention space 138. The tension in the tongue 112 which urges it to flex back towards its starting position may aid in capturing the bag between the tongue 112 and the back 110 and thereby may aid retention of the bag.

To then remove the bag, for example to replace the bag, the user would have to apply some force to pull the bag material and edge out of the bag retention space 138, specifically from between the back 110 and the tongue 112 and from between the fin 142 and the tongue 112. The tongue 112 might further flex away from the back 110 as the material of the bag is pulled out of the bag retention space 138 through the mouth 140. Finally, after the bag is released from the bag retention clip 18, the tongue 112 would flex back to its starting position.

The bag retention clip 18 may be produced from any suitable material that allows for the requisite flexibility of the joint 114 and/or tongue 112.

Referring now to FIGS. 14 and 15, further embodiments of the container system 10 will be described.

The embodiment of the container system 10 shown in FIG. 14 differs primarily from the embodiment shown in FIGS. 1 to 9 in that the container 12 is a double container 148 with two openings 44 in the cover 14. The double container 148 is dimensioned to allow two liners 16 to be placed into it side-by-side to collect two different kinds of waste or recyclables. For example, plastic recyclables could be collected on one side of the double container 148, while paper recyclables could be collected on the other side. As noted above, the different types of recyclables or waste intended for each side of the double container 148 can be indicated using the label recesses 46 and/or the shape of the openings 44 in the cover 14.

Similarly, FIG. 15 shows a further embodiment of the container system 10 where the container 12 is a triple container 150. The triple container 150 is dimensioned to allow three liners 16 to be placed side-by-side.

For both the double and triple containers 148 and 150, the liners 16 can be placed in the second position as described above independently of each other, for example, if one bag collecting one type of recyclables is already full and needs replacement while the other bags are not yet full.

Notwithstanding the above, although the double and triple containers 148 and 150 may permit two and three liners 16, respectively, to be placed side-by-side, a user may also use a liner 16 in one location, but use only a bag, held in place with the bag retention clips 18, in a second location. One such possible configuration is shown for each of FIGS. 14 and 15, where the liners 16, bag 17 and clips 18 are shown in dotted lines behind the walls 26 of the containers 148 and 150. It is noted that other internal features, such as the bottom edge of the cover 14, is not shown behind the walls of the containers 148 and 150.

In the embodiments shown, there is only one cover 14 for each of the double and triple containers 148 and 150. In other embodiments there may be two or three covers 14, respectively, for each of the double and triple containers 148 and 150. For example, the double container 148 may have two covers side by side so that only one cover needs to be raised to replace a bag in the liner 16 on that side of the container 148.

As with the single container embodiment shown in FIGS. 1 and 2, bag retention clips 18 are provided in the double and triple containers 148 and 150 to at least support the cover 14 in the closed position even if the bag retention clips 18 would not be used for keeping a bag in place. For instance, the double container could have two bag retention clips 18 on the front wall and one on each side wall as shown in dotted lines in FIG. 14.

It is noted that the designation of front, back, top, bottom, upward and downward, frontwards and backwards in this description is for ease of reference and is not intended to be limiting.

Moreover, what has been described is merely illustrative of the application of principles of embodiments of the present disclosure. Other embodiments, arrangements and methods can be implemented by those skilled in the art without departing from the scope of the present disclosure.

The invention claimed is:

1. A waste or recycling container system comprising:

a container comprising a container base and one or more container walls extending upwardly from the container base, the one or more container walls defining a first interior space and a first opening with a first rim; and one or more rigid liners for inserting into the first interior space, each liner comprising:

a liner base and one or more liner walls extending upwardly from the liner base, the one or more liner walls defining a second interior space into which waste or recycling is placed and a second opening with a second rim, a supporting structure provided on one of the one or more liner walls, the supporting structure comprising one or more anchor portions, the one or more anchor portions each having a guiding wall with a planar surface substantially parallel to the one liner wall, the planar surface extending from a lower edge of the anchor portion to an upper edge of the guiding wall, the upper edge of the guiding wall being part of an upper edge of the second rim, one or more bag retention structures provided on the one or more liner walls, and a handle, the handle being recessed with respect to the guiding wall, wherein each liner is capable of being placed in the first interior space in at least a first position and a second position, wherein, in the first position, the bag retention structures are below the first opening, and wherein, in the second position, the supporting structure rests on a resting portion of the one or more container walls and the liner is elevated with respect to the first position such that the one or more bag retention structures are positioned higher than the first rim and vertically spaced apart from the first rim.

2. The system of claim 1, wherein the first rim comprises the resting portion.

3. The system of claim 2, wherein the supporting structure comprises a cantilever extending from the one liner wall for resting on the first rim in the second position.

4. The system of claim 3, wherein the cantilever extends across a width of the one liner wall.

5. The system of claim 3, wherein the one or more anchor portions extend downwardly from an end of the cantilever for forming a channel between the one or more anchor portions and the one liner wall, the channel having a channel profile.

6. The system of claim 5, wherein the channel profile is complementary to a rim profile of the first rim.

7. The system of claim 3, wherein the handle is provided at a midpoint of a width of the cantilever.

8. The system of claim 7, wherein the handle is formed by a portion of a handle wall between a handle cutout provided in the handle wall and the second opening, the handle wall extending upwardly from an end of the cantilever.

9. The system of claim 8, wherein one of the one or more bag retention structures comprises a cutout.

10. The system of claim 1, wherein the one or more anchor portions comprise two anchor portions provided symmetrically about the handle.

11. The system of claim 1, wherein one of the one or more bag retention structures comprises a cutout.

12. The system of claim 11, wherein the one or more liner walls comprise two liner walls that meet at an edge, and wherein the cutout extends across the edge.

13. The system of claim 1, wherein the liner is a moulded, unitary piece.

14. A rigid liner for a waste or recycling container, the liner comprising:

a liner base and one or more liner walls extending upwardly from the liner base, the one or more liner walls defining an interior space and an opening with a rim, a supporting structure for supporting the liner on the container, the supporting structure provided on one of the one or more liner walls, wherein the supporting structure comprises a cantilever for resting on a resting portion of the container, the cantilever extending from the one liner wall and one or more anchor portions extending downwardly from an end of the cantilever for forming a channel between the one or more anchor portions and the one liner wall, wherein each of the one or more anchor portions has a guiding wall with a planar surface substantially parallel to the one liner wall, the planar surface extending from a lower edge of the anchor portion to an upper edge of the guiding wall, the upper edge of the guiding wall being part of an upper edge of the rim;

a handle, the handle being recessed from the guiding wall; and one or more bag retention structures provided on the one or more liner walls, wherein the one or more bag retention structures are positioned higher than the cantilever with respect to the liner base.

15. The liner of claim 14, wherein the handle is provided at a midpoint of a width of the cantilever.

16. The liner of claim 15, wherein the handle is formed by a portion of a handle wall between a handle cutout provided in the handle wall and the opening, the handle wall extending upwardly from an end of the cantilever.

17. The liner of claim 16, wherein one of the one or more bag retention structures comprises a cutout.

18. The liner of claim 14, wherein the one or more anchor portions comprise two anchor portions provided symmetrically about the handle.

19. The liner of claim 14, wherein the cantilever extends across a width of the one liner wall.

20. The liner of claim 14, wherein one of the one or more bag retention structures comprises a cutout.

21. The liner of claim 20, wherein the one or more liner walls comprise two liner walls that meet at an edge, and wherein the cutout extends across the edge.

22. The liner of claim 14, wherein the liner is at least partially nestable with another identical liner.

23. The liner of claim 14, the liner being a moulded, unitary piece.

24. A waste or recycling container system comprising:

a container comprising a container base and one or more container walls extending upwardly from the container base, the one or more container walls defining a first interior space and a first opening with a rim; and one or more liners according to claim 14, wherein each liner is capable of being placed in the first interior space in at least a first position and a second position, wherein, in the first position, the bag retention structures are below the first opening, and wherein, in the second position, the cantilever of the liner rests on the rim of the container.

* * * * *